US009340940B2

(12) United States Patent
Neelamani et al.

(10) Patent No.: US 9,340,940 B2
(45) Date of Patent: May 17, 2016

(54) FLOATING BREAKWATER

(71) Applicant: KUWAIT INSTITUTE FOR SCIENTIFIC RESEARCH, Safat (KW)

(72) Inventors: Subramaniam Neelamani, Safat (KW); Khaled Al-Banaa, Safat (KW)

(73) Assignee: KUWAIT INSTITUTE FOR SCIENTIFIC RESEARCH, Safat (KW)

( * ) Notice: Subject to any disclaimer, the term of this patent is extended or adjusted under 35 U.S.C. 154(b) by 0 days.

(21) Appl. No.: 14/464,682

(22) Filed: Aug. 20, 2014

(65) Prior Publication Data

US 2016/0053454 A1 Feb. 25, 2016

(51) Int. Cl.
*E02B 3/06* (2006.01)
*E02B 3/04* (2006.01)

(52) U.S. Cl.
CPC ..... *E02B 3/04* (2013.01)

(58) Field of Classification Search
CPC ..... E02B 3/06; E02B 3/062
See application file for complete search history.

(56) References Cited

U.S. PATENT DOCUMENTS

| | | | | |
|---|---|---|---|---|
| 3,800,543 | A | 4/1974 | Moore | |
| 4,006,598 | A * | 2/1977 | Hulsemann | 405/25 |
| 4,136,994 | A * | 1/1979 | Fuller | 405/27 |
| 4,225,268 | A | 9/1980 | Treu | |
| 4,768,896 | A | 9/1988 | Moore | |
| 6,102,625 | A | 8/2000 | Olsen et al. | |
| 6,652,193 | B2 * | 11/2003 | Matsuura et al. | 405/195.1 |
| 2003/0147696 | A1 * | 8/2003 | Hulsemann et al. | 405/21 |
| 2008/0022915 | A1 * | 1/2008 | Budd | 114/355 |
| 2010/0074686 | A1 | 3/2010 | Towley, III | |

FOREIGN PATENT DOCUMENTS

JP 61-176711 8/1986

OTHER PUBLICATIONS

Website, http://cedb.asce.org/cgi/WWWdisplay.cgi?85394, Abstract of paper titled *Wave Diffraction by Array of Thin-Screen Breakwaters, Journal of Waterway, Port, Coastal and Ocean Engineering*, vol. 119, No. 6, (Nov./Dec. 1993), pp. 606-617 (Abstract only-one page, downloaded on Aug. 6, 2012).

* cited by examiner

*Primary Examiner* — Benjamin Fiorello
(74) *Attorney, Agent, or Firm* — Richard C. Litman

(57) ABSTRACT

The floating breakwater includes various different embodiments, as can have an anchored or moored float. The float is desirably in the geometric form of a generally rectangular solid configuration, but can include other forms. One or more baffles or skirt walls extend from the bottom surface of the float, thereby attenuating subsurface wave action to a greater depth than the bottom of the float. Each of the baffles or skirt walls desirably includes a thin, flat, monolithic plate member for enhancing hydrodynamic resistance. The one or more baffles or skirt walls can be continuous and unbroken, or can have a plurality of apertures therethrough. When three or more baffles or skirt walls are provided they can be evenly spaced, or the spacing therebetween can vary. When two or more baffles or skirt walls are provided they can have equal depths, or their depths can differ from one another.

8 Claims, 5 Drawing Sheets

710

FLOATING BREAKWATER

BACKGROUND OF THE INVENTION

1. Field of the Invention

The present invention relates generally to devices and systems for controlling water movement in maritime environments, and more specifically to a floating breakwater having one or more baffles or skirt walls depending therefrom.

2. Description of the Related Art

Breakwaters for the control of wave action in order to prevent damage or destruction of shoreline property and/or environment have been known for a considerable period of time. Perhaps most such breakwaters are permanent installations formed of rock, concrete, scrapped automobiles and/or ships, or other reasonably economical and durable materials.

It was discovered that it is not necessary to construct a breakwater that extends up from the sea floor, as wave action is typically confined to the upper strata of the water. Accordingly, it has been found that reasonably large floats can also provide the desired attenuation of wave action, when provided with the proper characteristics and moored in appropriate locations.

Waves have two primary properties, i.e., wavelength and amplitude. In order to attenuate the waves, the floating breakwater must have a span, i.e., a dimension extending in the direction of wave travel, typically on an order of the wave length, for example. A greater span is generally more effective. Moreover, the floating breakwater must have a reasonably deep draft to extend to a depth at least equal to the amplitude of the waves, if not to a greater depth. Also, a hydrodynamic resistive shape is desirable, rather than a more streamlined shape.

Accordingly, the typical floating breakwater is in the form of a rectangular solid, as can have a generally hollow interior, due to its ease of construction and high hydrodynamic resistance. However, most such floats have relatively shallow drafts and spans, i.e., they do not extend below the surface of the water to a significant degree and do not extend to a significant fraction of the wavelength. Thus, even when the floating breakwater is moored securely to the sea floor or to a floor of a body of water, wave propagation typically cannot be reduced significantly if the wave action extends beneath the floating breakwater. While it can be possible to construct floating breakwaters that are sufficiently large as to provide the desired degree of effectiveness, the cost of such breakwaters can be prohibitive when attempting to attenuate large waves and swells.

A number of different floating breakwater configurations have been developed in the past, as noted further above. An example is found in Japanese Patent Publication No. 61-176711 published on Aug. 8, 1986 to Hitachi Shipbuilding Eng. Co. This document describes a rectangular floating breakwater, with a wing connected to the leading side of the breakwater by connecting bars and hinges. When wave action moves the wing in a vertically rocking manner, a propulsion force is transmitted to the bars and the breakwater is pulled to offset some of the forces of the waves.

Thus, a floating breakwater addressing the aforementioned problems is desired.

SUMMARY OF THE INVENTION

Embodiments of a floating breakwater include a generally rectangular shaped float with one or more skirt walls or baffles depending from the bottom surface thereof. The baffles or skirt walls extend to a depth significantly greater than the draft of the float, and can provide attenuation of the wave action to a greater depth than the draft of the float alone.

Embodiments of a floating breakwater can have only a single depending baffle or skirt wall, or can have two or more baffles or skirt walls depending from the bottom of the float. The baffle or baffles, or skirt wall or skirt walls, can have solid and unbroken surfaces, or can be porous with a series of apertures or perforations therethrough to alter its characteristics, such as in relation to attenuation of wave action. The plural baffles or skirt walls can be evenly spaced from one another, or can have varying spacing therebetween. The plural baffles or skirt walls can all have substantially the same depth, i.e., vertical extent from the bottom of the float, or can have two or more different depths, as desired.

These and other features of the present invention will become readily apparent upon further review of the following specification and drawings.

BRIEF DESCRIPTION OF THE DRAWINGS

Unless otherwise indicated, similar reference characters denote corresponding features consistently throughout the attached drawings.

DETAILED DESCRIPTION OF THE PREFERRED EMBODIMENTS

The floating breakwater includes various embodiments, each having at least one baffle or skirt wall depending therefrom. The one or more baffles or skirt walls can effectively increase the draft or depth of the float, and can serve to interfere with wave circulation beneath the surface of the water and below the bottom of the float to increase the efficiency of the floating breakwater to attenuate the wave action.

Figure 1:
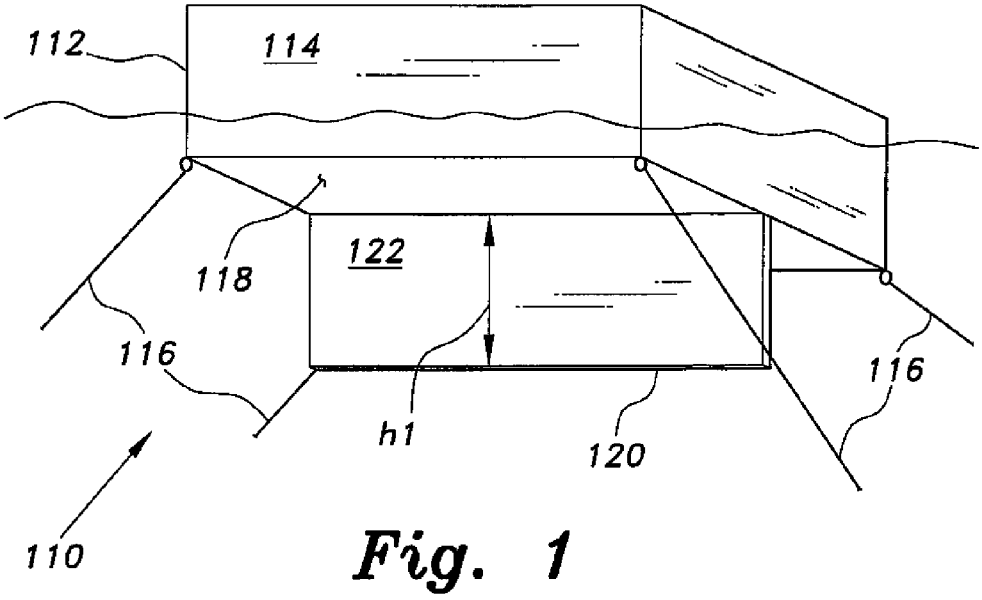
FIG. 1 is a bottom perspective view of an embodiment of a floating breakwater according to the present invention, illustrating its general configuration and features.

FIG. 1 of the drawings is a bottom perspective view of an embodiment of a floating breakwater 110. The floating breakwater 110 includes a buoyant float 112, which can be of any suitable shape or configuration. However, the float 112 is desirably in the geometric form of a generally rectangular parallelepiped configuration, as shown in FIG. 1 and in embodiments illustrated in FIGS. 2-6, for example. This configuration can enable the floating breakwater 110 to be installed with one of its two longer vertical surfaces, e.g., the front surface 114, facing directly into the oncoming waves.

The generally blunt, flat vertical surface 114, in combination with the generally squared edges and vertical rear surface, can assist in creating significant turbulence in the water as the waves pass around the float 112, thereby canceling much of the relatively smooth oscillation of the waves to provide attenuation of the wave action. The float 112 can be restrained at the position desired, such as by a plurality of mooring lines 116 extending therefrom and anchored conventionally in or to the underlying sea floor or in or to an underlying floor of a body of water, for example.

The generally rectangular parallelepiped configuration of the float 112 can include a generally flat, planar bottom surface 118, for example. In an embodiment of a floating breakwater of FIG. 1, a single skirt wall or baffle 120 extends downward from the general center of the bottom surface 118, with its front face 122 aligned parallel or substantially parallel to the front surface 114 of the float 112 in order to maximize the flat plate area presented to the oncoming waves. Thus, the plane of the baffle or skirt wall 120 is normal or substantially normal to the plane of the bottom surface 118 of the float 112, for example. The baffle or skirt wall 120 can desirably be formed of a relatively thin monolithic plate, such as a solid plate having a continuous or unbroken surface, with sufficient thickness to resist appreciable bending due to hydrodynamic forces when deployed. The depth h1 of the baffle or skirt wall 120 can be adjusted as needed to provide sufficient dissipation or attenuation of the wave action, such as depending upon the amplitudes and wave lengths of the anticipated oncoming waves.

Figure 2:
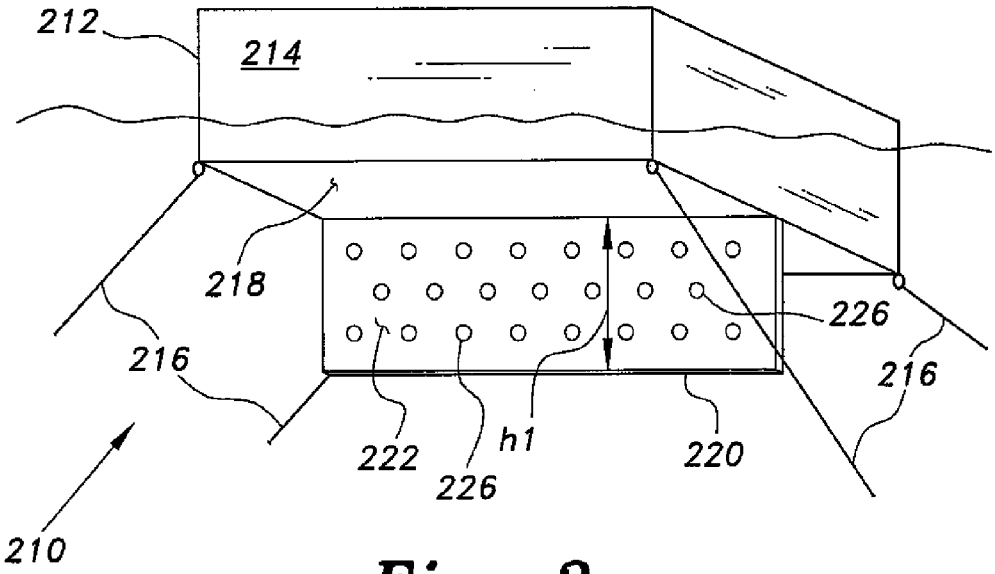
FIG. 2 is a bottom perspective view of an embodiment of the floating breakwater according to the present invention, illustrating various details thereof.

FIG. 2 illustrates a bottom perspective view of an embodiment of a floating breakwater, designated as floating breakwater 210. The floating breakwater 210 is of substantially the same configuration as the floating breakwater 110 of FIG. 1, i.e., having a float 212 of a generally rectangular parallelepiped configuration with a front surface 214, mooring lines 216, and a bottom surface 218. A single baffle or skirt wall 220 extends from beneath the bottom surface 218, with its front face 222 being normal or substantially normal to the bottom surface 218, but the arrangement and position of the baffle or skirt wall 220 should not be construed in a limiting sense.

The baffle or skirt wall 220 also has a depth h1 extending significantly below the bottom surface 218 of the float 212, in order to assist in dissipating wave motion beneath the surface of the water, the depth h1 of the baffle or skirt wall 220 can be the same or different from the depth h1 of the baffle or skirt wall 120 of FIG. 1, depending on the use or application, for example. The depth h1 of the baffle or skirt wall 220 can be adjusted as needed to provide sufficient dissipation or attenuation of the wave action, such as depending upon the amplitudes and wave lengths of the anticipated waves.

The embodiment of the floating breakwater 210 differs from the embodiment of the floating breakwater 110 in that the baffle or skirt wall 220 is porous, i.e., the baffle or skirt wall 220 can have from a relatively small to a relatively large number of apertures or perforations 226 therethrough, rather than having a continuous and unbroken surface as in the baffle or skirt wall 120 of the embodiment of the floating breakwater 110 of FIG. 1, with the number and type of perforations or apertures 226 depending on the particular use or application and should not be construed in a limiting sense.

The porosity provided by the perforations or apertures 226 can allow some water to flow through the baffle or skirt wall 220, but the turbulence created by the water flowing through the apertures or perforations 226 can also create a significant hydrodynamic drag or resistance. This hydrodynamic resistance can assist in disrupting the otherwise relatively smooth and regular oscillation of the wave action, and thereby can assist in reducing the amplitude of the waves to attenuate the wave action.

Figure 3:
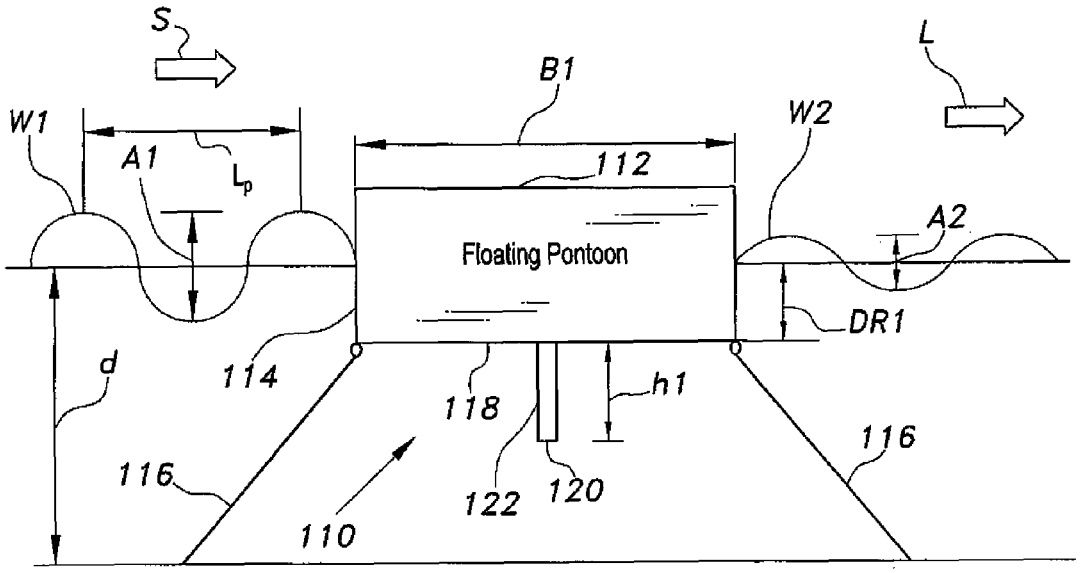
FIG. 3 is a side elevation view of the floating breakwater embodiment of FIG. 1 according to the present invention, illustrating further details thereof.

FIG. 3 illustrates a side elevation view of the embodiment of the floating breakwater 110 of FIG. 1, although it will be seen that this view is also similar to that for the floating breakwater 210 of FIG. 2, as well. The float 112 of the floating breakwater 110 has a width B1, i.e., the width B1 being the dimension of the float 112 parallel or substantially parallel to the direction of wave travel, and is anchored at a water depth "d" with a draft DR1 below the average or still water surface. Also, the width B1 can also be adjusted in relation to the depth h1 of the baffle or skirt wall 120, as well as can be adjusted in relation to other factors or characteristics, such as described herein, to provide relatively sufficient dissipation of the wave action, depending upon the amplitudes and wave lengths of the anticipated oncoming waves, for example.

In FIG. 3, the waves W1 are approaching from the left as indicated by the seaward horizontal arrow S, with the waves having an amplitude A1. As the waves W1 contact the floating breakwater 110, and particularly its depending baffle or skirt wall 120, the generally regular oscillation of the waves W1 is disturbed and attenuated to form receding waves W2 with a lesser amplitude A2 as shown on the right side of the floating breakwater 110 of FIG. 3, traveling in the direction indicated by the leeward arrow L. The baffle or skirt wall 120 can be porous or perforated, such as can include the apertures of perforations 226 similar to those of the embodiment of the baffle or skirt wall 220 of FIG. 2, for example.

Figure 4:
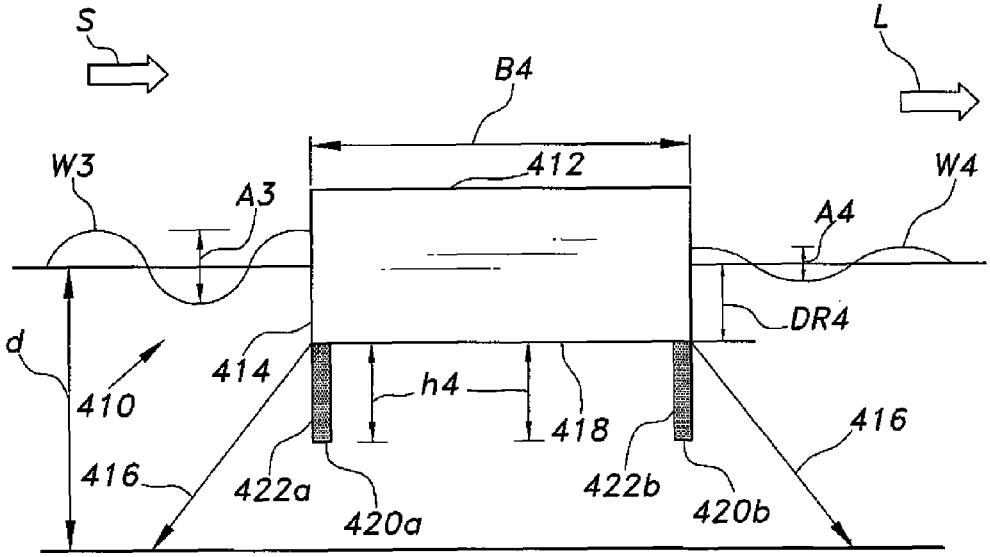
FIG. 4 is a side elevation view of another embodiment of the floating breakwater according to the present invention, illustrating a double baffle or skirt wall configuration.

FIG. 4 illustrates a side elevation view of an embodiment of a floating breakwater, designated as floating breakwater 410. The floating breakwater 410 is of substantially the same configuration as the floating breakwater 110 of FIG. 1, i.e., having a float 412 of a generally rectangular parallelepiped configuration with a front surface 414, mooring lines 416, and a bottom surface 418. The float 412 of the floating breakwater 410 has a width B4, i.e., the width B4 being the dimension of the float 412 parallel or substantially parallel to the direction of wave travel, and is anchored at a water depth "d" with a draft DR4 below the average or still water surface.

However, rather than having only a single baffle or skirt wall, the floating breakwater 410 includes two baffles or skirt walls 420*a* and 420*b*. The two baffles or skirt walls 420*a* and 420*b* can depend from the opposite forward and rearward edges of the bottom surface 418 as shown, or from other areas of the bottom surface 418, as desired. The front faces 422*a* and 422*b* of the two baffles or skirt walls 420*a* and 420*b* are parallel or substantially parallel to the front surface 414 of the float 412 and to one another, i.e., normal or substantially normal to the bottom surface 418, but such arrangement and position of the two baffles or skirt walls 420*a* and 420*b* in relation of the bottom surface 418 should not be construed in a limiting sense. Each of the two baffles or skirt walls 420*a* and 420*b* has a depth h4 extending significantly below the bottom surface 418 of the float 412, in order to assist in dissipating wave motion beneath the surface of the water.

The two baffles or skirt walls 420*a* and 420*b* can be of equal depth h4 to one another, as shown, or can alternatively have different depths from one another. One or both of the baffles or skirt walls 420*a* and 420*b* can be porous or perforated, as in the case of the embodiment of the baffle or skirt wall 220 having the apertures or perforations 226 of FIG. 2, for example. The depths h4 of the baffles or skirt walls 420*a* and 420*b* can be adjusted, as well as the width B4 of the float 412 can also be adjusted in relation to the depth h4 of the baffles or skirt walls 420*a* and 420*b*, as needed, to provide relatively sufficient dissipation of the wave action, depending upon the amplitudes and wave lengths of the anticipated oncoming waves, for example.

The side elevation view of FIG. 4 also illustrates the wave action of the approaching waves W3 and receding waves W4, and their relative amplitudes A3 and A4 as affected by the floating breakwater 410. In FIG. 4, the waves W3 are approaching from the left as indicated by the seaward horizontal arrow S, with the waves having an amplitude A3. As the waves W3 contact the floating breakwater 410, and particularly its two depending skirt walls or baffles 420*a* and 420*b*, the generally regular oscillation of the waves W3 is disturbed and attenuated to form receding waves W4 with a lesser amplitude A4 as shown on the right side of the floating breakwater 410 of FIG. 4, traveling in the direction indicated by the leeward arrow L.

Figure 5:
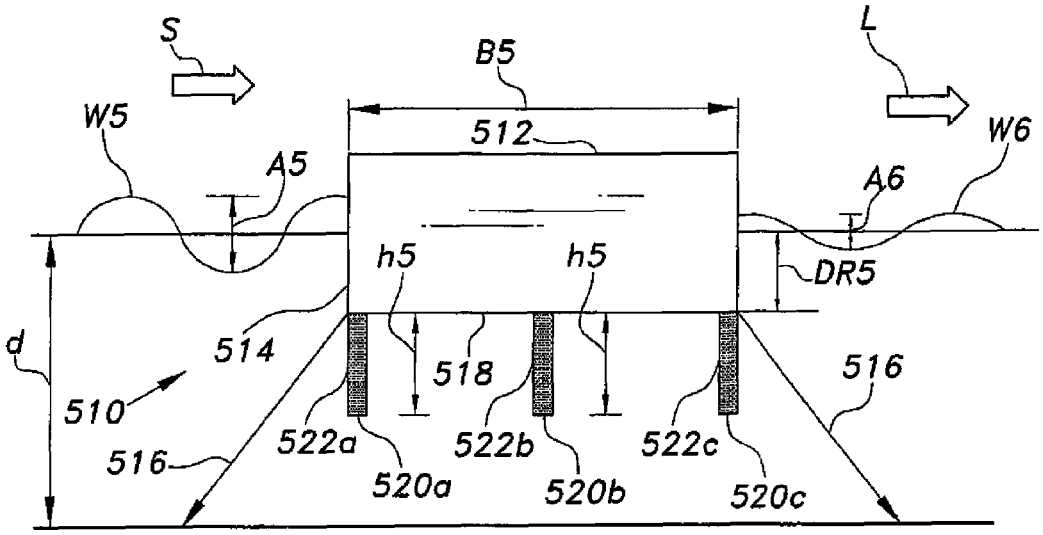
FIG. 5 is a side elevation view of another embodiment of the floating breakwater according to the present invention, illustrating a triple baffle or skirt wall configuration.

FIG. 5 of the drawings illustrates a side elevation view of a further embodiment of a floating breakwater, designated as floating breakwater 510. The floating breakwater 510 is of substantially the same configuration as the floating breakwater 110 of FIG. 1, i.e., having a float 512 of a generally rectangular parallelepiped configuration with a front surface 514, mooring lines 516, and a bottom surface 518. The float 512 of the floating breakwater 510 has a width B5, i.e., the width B5 being the dimension of the float 512 parallel or substantially parallel to the direction of wave travel, and is anchored at a water depth "d" with a draft DR5 below the average or still water surface.

However, rather than having only a single baffle or skirt wall, the floating breakwater 510 includes three baffles or skirt walls 520*a*, 520*b* and 520*c*. The forward and rearward baffles or skirt walls 520*a* and 520*c* can depend from the opposite forward and rearward edges of the bottom surface 518 as shown, with the baffle or skirt wall 520*b* positioned at a location between the baffles or skirt walls 520*a* and 520*c*, or the baffles or skirt walls 520*a*, 520*b* and 520*c* can depend from other areas of the bottom surface 518, as desired, depending on the use or application, and the arrangement and position of the baffles or skirt walls 520*a*, 520*b* and 520*c* should not be construed in a limiting sense.

The front faces 522*a*, 522*b* and 522*c* of the three baffles or skirt walls 520*a*, 520*b* and 520*c* can be positioned parallel or substantially parallel to the front surface 514 of the float 512 and to one another, i.e., normal or substantially normal to the bottom surface 518. Each of the baffles or skirt walls 520*a*, 520*b* and 520*c* has a depth h5 extending significantly below the bottom surface 518 of the float 512, in order to dissipate wave motion beneath the surface of the water.

Also, the three baffles or skirt walls 520*a*, 520*b* and 520*c* can be of an equal depth h5 to one another, as shown, or can alternatively have different depths from one another, for example, depending on the use or application. The three baffles or skirt walls 520*a*, 520*b* and 520*c* can be evenly spaced from one another, as shown, or the first two baffles or skirt walls 520*a* and 520*b* can have different spacing (greater or lesser) than the second and third baffles or skirt walls 520*b* and 520*c*, for example.

One or more of the baffles or skirt walls 520*a*, 520*b* and 520*c* can be porous or perforated, as in the case of the embodiment of the baffle or skirt wall 220 having the apertures or perforations 226 of FIG. 2, for example. The depths h5 of the baffles or skirt walls 520*a*, 520*b* and 520*c* can be adjusted, as well as the width B5 of the float 512 can also be adjusted in relation to the depth h5 of the baffles or skirt walls 520*a*, 520*b* and 520*c*, as needed, to provide sufficient dissipation of the wave action, depending upon the amplitudes and wave lengths of the anticipated oncoming waves, for example.

The side elevation view of FIG. 5 also illustrates the wave action of the approaching waves W5 and receding waves W6, and their relative amplitudes A5 and A6 as affected by the floating breakwater 510. In FIG. 5, the waves W5 are approaching from the left as indicated by the seaward horizontal arrow S, with the waves having an amplitude A5. As the waves W5 contact the floating breakwater 510, and particularly its three depending baffles or skirt walls 520*a*, 520*b* and 520*c*, the generally regular oscillation of the waves W5 is disturbed and attenuated to form receding waves W6 with a lesser amplitude A6 as shown on the right side of the floating breakwater 510 of FIG. 5, traveling in the direction indicated by the leeward arrow L.

Figure 6:
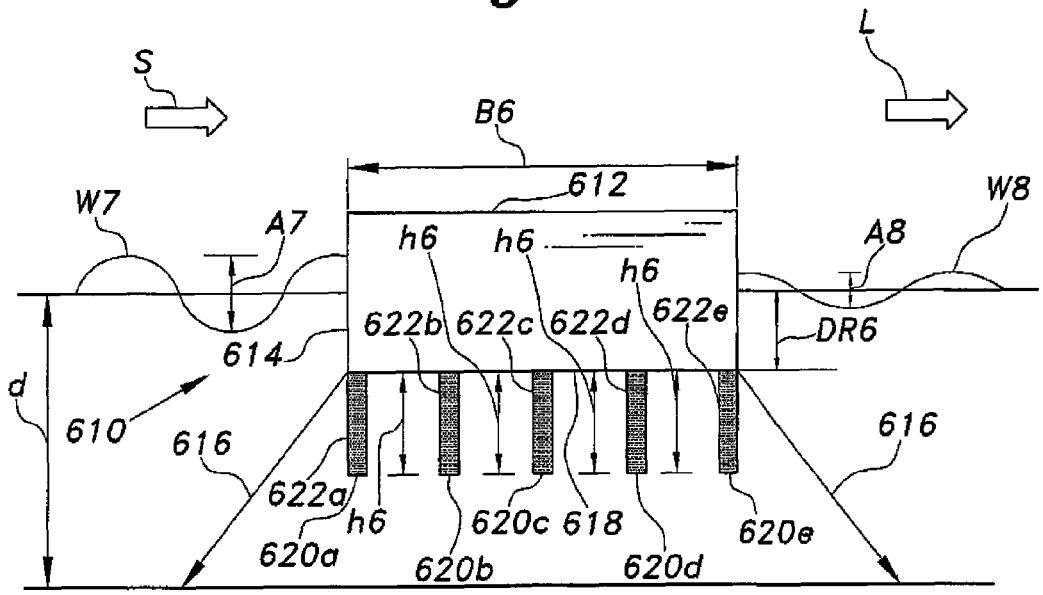
FIG. 6 is a side elevation view of another embodiment of the floating breakwater according to the present invention, illustrating a five baffle or skirt wall configuration.

FIG. 6 of the drawings illustrates a side elevation view of a further embodiment of a floating breakwater, designated as floating breakwater 610. The floating breakwater 610 is of substantially the same configuration as the floating breakwater 110 of FIG. 1, i.e., having a float 612 of a generally rectangular parallelepiped configuration with a front surface 614, mooring lines 616, and a bottom surface 618. The float 612 of the floating breakwater 610 has a width B6, i.e., the width B6 being the dimension of the float 612 parallel or substantially parallel to the direction of wave travel, and is anchored at a water depth "d" with a draft DR6 below the average or still water surface.

However, rather than having only a single baffle or skirt wall, the floating breakwater 610 includes five baffles or skirt walls 620*a*, 620*b*, 620*c*, 620*d* and 620*e*. The forward and rearward baffles or skirt walls 620*a* and 620*e* can depend from the opposite forward and rearward edges of the bottom surface 618 as shown, with the baffles or skirt walls 620*b*, 620*c* and 620*d* positioned at various locations between the baffles or skirt walls 620*a* and 620*e*, or the baffles or skirt walls 620*a*, 620*b*, 620*c*, 620*d* and 620*e* can depend from other areas of the bottom surface 618, as desired, depending on the use or application, and the arrangement and position of the baffles or skirt walls 620*a*, 620*b*, 620*c*, 620*d* and 620*e* should not be construed in a limiting sense. The front faces 622*a*, 622*b*, 622*c*, 622*d* and 622*e* of the five baffles or skirt walls 620*a*, 620*b*, 620*c*, 620*d* and 620*e* are parallel or substantially parallel to the front surface 614 of the float 612 and to one another, i.e., normal or substantially normal to the bottom surface 618.

Each of the baffles or skirt walls 620*a*, 620*b*, 620*c*, 620*d* and 620*e* has a depth h6 extending significantly below the bottom surface 618 of the float 612, in order to dissipate wave motion beneath the surface of the water. The depths h6 of the baffles or skirt walls 620*a*, 620*b*, 620*c*, 620*d* and 620*e* can be adjusted, as well as the width B6 of the float 612 can also be adjusted in relation to the depth h6 of the baffles or skirt walls 620*a*, 620*b*, 620*c*, 620*d* and 620*e*, as needed, to provide sufficient dissipation of the wave action, depending upon the amplitudes and wave lengths of the anticipated oncoming waves, for example.

The five baffles or skirt walls 620*a*, 620*b*, 620*c*, 620*d* and 620*e* can be of an equal depth to one another, as shown, or two or more of the baffles or skirt walls 620*a*, 620*b*, 620*c*, 620*d* and 620*e* can have different depths from one another, depending on the use or application. The five baffles or skirt walls 620*a*, 620*b*, 620*c*, 620*d* and 620*e* can be evenly spaced from one another, as shown, or one or more of the baffles or skirt walls 620*a*, 620*b*, 620*c*, 620*d* and 620*e* can have different spacing (greater or lesser) than other of the baffles or skirt walls 620*a*, 620*b*, 620*c*, 620*d* and 620*e*, for example. One or more of the baffles or skirt walls 620*a*, 620*b*, 620*c*, 620*d* and 620*e* can be perforated or porous, as in the case of the embodiment of the baffle or skirt wall 220 having the apertures or perforations 226 of FIG. 2, for example.

The side elevation view of FIG. 6 also illustrates the action of the approaching waves W7 and receding waves W8, and their relative amplitudes A7 and A8 as affected by the floating breakwater 610. In FIG. 6, the waves W7 are approaching from the left as indicated by the seaward horizontal arrow S, with the waves having an amplitude A7. As the waves W7 contact the floating breakwater 610, and particularly its five depending baffles or skirt walls 620*a*, 620*b*, 620*c*, 620*d* and 620*e*, the generally regular oscillation of the waves W7 is disturbed and attenuated to form receding waves W8 with a lesser amplitude A8 as shown on the right side of the floating breakwater 610 of FIG. 6, traveling in the direction indicated by the leeward arrow L.

Introduction of a baffle or skirt wall or a plurality of baffles or skirt walls, such as two, three or five baffles or skirt walls, such as described in relation to FIGS. 1-6, respectively, as can be arranged in a row, for example, can change hydrodynamic performance characteristics, such as wave transmission, wave reflection and wave energy dissipation, as can reduce the wave transmission because of a damping effect on the wave action, for example. Introducing porosity in the baffles or skirt walls can change the wave transmission characteristics, such as the wave transmission and wave energy transmission, as can be due to the interaction of water particle motion through the apertures or perforations in the baffle or skirt wall, as can assist in attenuation of wave action, for example.

A series of trials were carried out using a physical model study of various embodiments of floating breakwaters in a wave flume. A total of 29 different embodiments of floating breakwater configurations were tested in the physical model study. Desirable options out of these 29 different configurations of embodiments of floating breakwaters were identified based on the analysis of transmitted wave heights. Relatively desirable options for configurations of embodiments of floating breakwaters, such as of those relatively desirable configurations from the 29 different floating breakwater configurations tested in the wave flume, are those which can yield the relatively least transmission wave height at the lee side of the floating breakwater. A float as can be used for the tests or analysis to which one or more baffles or skirt walls can be attached can be of a generally rectangular parallelepiped shape with dimensions of approximately 1.0 meter (m) by 0.58 m by 0.40 m, for example.

Figure 7:
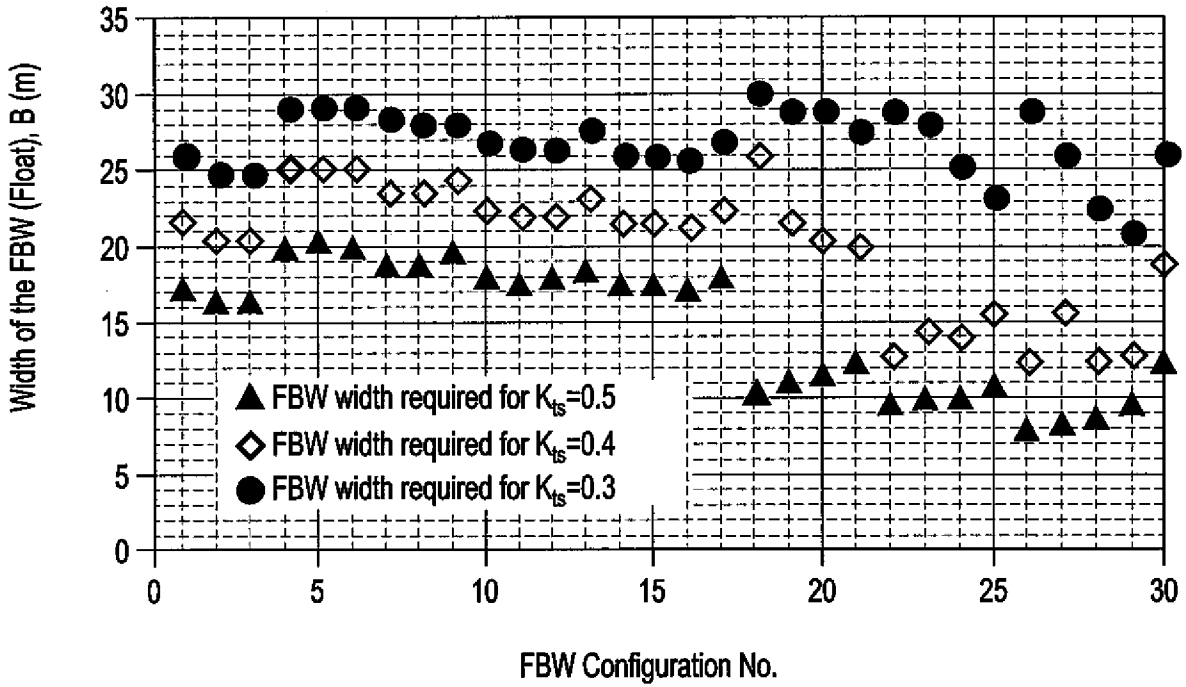
FIG. 7 is a graph illustrating various widths of floats corresponding to configurations of floating breakwaters for various wave transmission coefficients.

In this regard, FIG. 7 of the drawings illustrates a graph 710 of various floating breakwater (FBW) float widths B in meters (m), indicated along the vertical y-axis of the graph 710 in FIG. 7, of floats of floating breakwaters of various configurations (FBW Configuration No.), indicated along the horizontal x-axis of the graph 710 in FIG. 7, as corresponding to various wave transmission coefficients, designated as $K_{ts}$ in the notations in the body of the graph 710 of FIG. 7. In this regard, FIG. 7 illustrates the results of tests and analysis in a series of thirty trials of a physical model study indicated by the range of from one (1) to thirty (30), corresponding to various configuration numbers (nos.) of breakwaters, including floating breakwaters, as indicated along the horizontal x-axis of the graph 710.

The wave transmission coefficient, or $K_{ts}$, is the ratio of the significant transmitted wave height of an attenuated wave, e.g., corresponding to amplitude A2 of waves W2 in FIG. 3, to the significant incident wave height of an oncoming wave, e.g., corresponding to amplitude A1 of waves W1 in FIG. 3, such as in a random wave field. Also, for one or more wave transmission coefficients $K_{ts}$, the width B of the float of the floating breakwater and the incident wave length $L_p$ of the oncoming waves, such as the incident wave length $L_p$ corresponding to the waves W1 illustrated in FIG. 3, can be related by a relation $B/L_p$. Using the relation $B/L_p$, a reduction of the width B of the float of a floating breakwater in a direction parallel or substantially parallel to the direction of wave travel for a predetermined wave transmission coefficient $K_{ts}$ can be determined based on a value of a relation $B/L_p$, for example. The relative merits of adding one or more baffles or skirt walls in embodiments of a floating breakwater and of introducing different porosities in the one or more baffles or skirt walls is discussed and explained in relation to FIG. 7, the x-axis corresponding to the FBW configuration number (no.) of the respective embodiments of the floating breakwaters tested and analyzed.

The physical model tests of various embodiments of floating breakwaters corresponding to the configuration numbers (nos.) referred to in FIG. 7 were conducted in a wave flume. Regular and random waves for a wide range of wave heights and periods were generated. The transmitted wave heights and the reflected wave heights were measured for each wave height and period combinations. The various configurations of the floating breakwaters tested and analyzed were moored to the flume bed with slack mooring. The test and analysis included, for comparison, a conventional type pontoon type floating breakwater model, similar to that illustrated in FIG. 8 without a baffle or a skirt wall, as well as including a fixed pontoon breakwater.

The tests and analysis of embodiments of the floating breakwaters were carried out with 28 different embodiments of floating breakwaters (with 16 different single baffle or skirt wall embodiments, 4 different two baffles or skirt walls embodiments, 4 different three baffles or skirt walls embodiments and 4 different five baffles or skirt walls embodiments). The tests and analysis were carried out to assess the wave transmission, reflection and energy dissipation characteristics and to determine relatively desirable configurations from the 28 different embodiments of the floating breakwaters analyzed and tested. Desirable embodiments of floating breakwaters are configurations which have a minimum 'B' value for the width of the float of the floating breakwater, since cost savings can typically be expected to be relatively significant if the width of the float of the floating breakwater 'B' is smaller. The results of the analysis and tests are set forth below in Table 1.

TABLE 1

$B/L_p$ Values to Achieve $K_{ts}$ = 0.5, 0.4 and 0.3 for Floating Breakwater Configurations

| Configuration No. | $B/L_p$ value to achieve $K_{ts}$ = 0.5 | $B/L_p$ value to achieve $K_{ts}$ = 0.4 | $B/L_p$ value to achieve $K_{ts}$ = 0.3 | Breakwater Configuration Description |
|---|---|---|---|---|
| 1 | 0.43 | 0.54 | 0.65 | Floating pontoon breakwater without a skirt wall |
| 2 | 0.41 | 0.51 | 0.62 | Floating pontoon breakwater with single skirt wall of different height and porosity |
| 3 | 0.41 | 0.51 | 0.62 | |
| 4 | 0.50 | 0.63 | 0.73 | |
| 5 | 0.51 | 0.63 | 0.73 | |
| 6 | 0.50 | 0.63 | 0.73 | |
| 7 | 0.47 | 0.59 | 0.71 | |
| 8 | 0.47 | 0.59 | 0.7 | |
| 9 | 0.49 | 0.61 | 0.7 | |
| 10 | 0.45 | 0.56 | 0.67 | |
| 11 | 0.44 | 0.55 | 0.66 | |
| 12 | 0.45 | 0.55 | 0.66 | |

TABLE 1-continued

B/$L_p$ Values to Achieve $K_{ts}$ = 0.5, 0.4 and 0.3 for Floating Breakwater Configurations

| Configuration No. | B/$L_p$ value to achieve $K_{ts}$ = 0.5 | B/$L_p$ value to achieve $K_{ts}$ = 0.4 | B/$L_p$ value to achieve $K_{ts}$ = 0.3 | Breakwater Configuration Description |
|---|---|---|---|---|
| 13 | 0.46 | 0.58 | 0.69 | |
| 14 | 0.44 | 0.54 | 0.65 | |
| 15 | 0.44 | 0.54 | 0.65 | |
| 16 | 0.43 | 0.53 | 0.64 | |
| 17 | 0.45 | 0.56 | 0.67 | |
| 18 | 0.26 | 0.65 | 0.75 | Floating pontoon |
| 19 | 0.28 | 0.54 | 0.72 | breakwater with two |
| 20 | 0.29 | 0.51 | 0.72 | skirt walls of different |
| 21 | 0.31 | 0.50 | 0.69 | porosity |
| 22 | 0.24 | 0.32 | 0.72 | Floating pontoon |
| 23 | 0.25 | 0.36 | 0.70 | breakwater with three |
| 24 | 0.25 | 0.35 | 0.63 | skirt walls of different |
| 25 | 0.27 | 0.39 | 0.58 | porosity |
| 26 | 0.20 | 0.31 | 0.72 | Floating pontoon |
| 27 | 0.21 | 0.39 | 0.65 | breakwater with five |
| 28 | 0.22 | 0.31 | 0.56 | skirt walls of different |
| 29 | 0.24 | 0.32 | 0.52 | porosity |
| 30 | 0.31 | 0.47 | 0.65 | Fixed pontoon breakwater |

A further understanding of the various embodiments of floating breakwaters and the meaning of different configuration numbers for configuration nos. 1 to 29 of the embodiments of the floating breakwaters of Table 1 is further explained with reference to Table 2 below. For example, configuration no. 1 is a pontoon floating breakwater without any baffle or skirt wall and configuration no. 27 is an embodiment of a pontoon floating breakwater with five baffles or skirt walls, with a 5% porosity and a h/d=0.286, where 'h' is the height of the baffle or skirt wall (h=200 mm in configuration no. 27, for example) and "d" is the water depth. The porosity indicated in Table 2 corresponds to the percentage of the baffle or skirt wall that has apertures or perforations, such as the apertures of perforations 226 of FIG. 2, for example.

TABLE 2

Floating Breakwater (FBW) Configurations and Dimension and Porosity Details of Skirt Walls

| FBW Configuration No. | Type of FBW | Skirt Wall Depth, h in millimeters (mm) | h/d ("d" is the water depth) | Porosity in the Skirt Wall (%) |
|---|---|---|---|---|
| 1 | Pontoon (Reference case) | No skirt wall | | — |
| 2 | Pontoon with single skirt wall | 100 | 0.143 | 0.0 |
| 3 | Pontoon with single skirt wall | 100 | 0.143 | 5.0 |
| 4 | Pontoon with single skirt wall | 100 | 0.143 | 10.0 |
| 5 | Pontoon with single skirt wall | 100 | 0.143 | 20.0 |
| 6 | Pontoon with single skirt wall | 200 | 0.286 | 0.0 |
| 7 | Pontoon with single skirt wall | 200 | 0.286 | 5.0 |
| 8 | Pontoon with single skirt wall | 200 | 0.286 | 10.0 |
| 9 | Pontoon with single skirt wall | 200 | 0.286 | 20.0 |
| 10 | Pontoon with single skirt wall | 300 | 0.429 | 0.0 |
| 11 | Pontoon with single skirt wall | 300 | 0.429 | 5.0 |
| 12 | Pontoon with single skirt wall | 300 | 0.429 | 10.0 |
| 13 | Pontoon with single skirt wall | 300 | 0.429 | 20.0 |
| 14 | Pontoon with single skirt wall | 400 | 0.572 | 0.0 |
| 15 | Pontoon with single skirt wall | 400 | 0.572 | 5.0 |
| 16 | Pontoon with single skirt wall | 400 | 0.572 | 10.0 |
| 17 | Pontoon with single skirt wall | 400 | 0.572 | 20.0 |
| 18 | Pontoon with two skirt walls | 200 | 0.286 | 0.0 |
| 19 | Pontoon with two skirt walls | 200 | 0.286 | 5.0 |
| 20 | Pontoon with two skirt walls | 200 | 0.286 | 10.0 |
| 21 | Pontoon with two skirt walls | 200 | 0.286 | 20.0 |

TABLE 2-continued

Floating Breakwater (FBW) Configurations and Dimension and Porosity Details of Skirt Walls

| FBW Configuration No. | Type of FBW | Skirt Wall Depth, h in millimeters (mm) | h/d ("d" is the water depth) | Porosity in the Skirt Wall (%) |
|---|---|---|---|---|
| 22 | Pontoon with three skirt walls | 200 | 0.286 | 0.0 |
| 23 | Pontoon with three skirt walls | 200 | 0.286 | 5.0 |
| 24 | Pontoon with three skirt walls | 200 | 0.286 | 10.0 |
| 25 | Pontoon with three skirt walls | 200 | 0.286 | 20.0 |
| 26 | Pontoon with five skirt walls | 200 | 0.286 | 0.0 |
| 27 | Pontoon with five skirt walls | 200 | 0.286 | 5.0 |
| 28 | Pontoon with five skirt walls | 200 | 0.286 | 10.0 |
| 29 | Pontoon with five skirt walls | 200 | 0.286 | 20.0 |

From the analysis and testing of various embodiments of floating breakwaters, such as indicated from Tables 1 and 2, adding baffles or skirt walls to the floating breakwater, as in the embodiments described herein, can reduce the wave transmission from 20% to 30%, for example. While the addition of one or more baffles or skirt walls can increase the cost of the floating breakwater, if the width B of the float of the floating breakwater can be reduced significantly as a result of the addition of the one or more baffles or skirt walls, as in embodiments of a floating breakwater, then the total cost of the floating breakwater can be relatively significantly reduced.

In this regard, as evidenced from Tables 1 and 2, the width of the float of the floating breakwater can be reduced significantly without substantially increasing the wave transmission by addition of one or more baffles or skirt walls, such as by selecting a minimum width B of the float of a floating breakwater in relation to a number of baffles or skirt walls and the porosity of the skirt walls. Desirable configurations of embodiments of a floating breakwater are typically those having a float with a minimum of width, or "B" value, since the relative cost savings can be increased if the width B of the float of the floating breakwater is relatively smaller or can be reduced to achieve wave attenuation of a given level or amount, for example.

Figure 8:
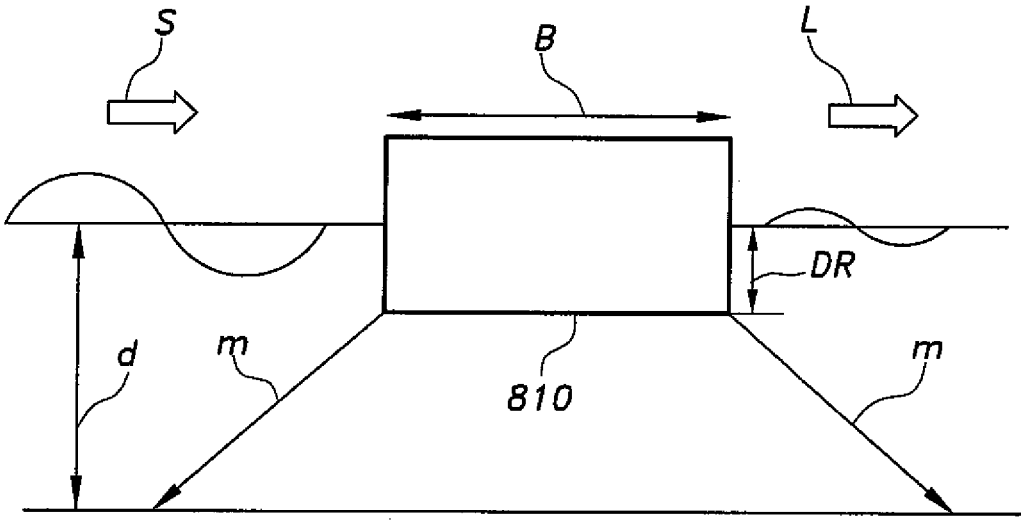
Fig. 8 Conventional Art
FIG. 8 is a side elevation view of a conventional floating breakwater having no depending baffles or skirt walls.

To achieve wave transmission coefficients $K_{ts}$ of 0.5, 0.4, and 0.3 for a conventional floating breakwater with no depending baffle or skirt wall, respective B/$L_p$ ratios of 0.43, 0.54, and 0.65 are typically needed. Such a conventional floating breakwater 810 devoid of any depending skirt walls or baffles is illustrated in FIG. 8 of the drawings and corresponds to configuration no. 1 in Tables 1 and 2. The floating breakwater 810 has an exemplary width B and draft DR, with the breakwater 810 being anchored by cables or mooring lines "m" at a depth "d" above the underlying surface. Wave direction is indicated by the seaward arrow S and leeward arrow L.

For example, for a design wave length of 40 meters, a floating breakwater (FBW) with no depending baffle or skirt wall and having a float of a width B of 17.2 meters is typically needed to attenuate fifty percent (50%) of the incident wave height on the lee side of the floating breakwater (FBW), a float of a width B of 21.6 meters is typically needed to attenuate sixty percent (60%) of the incident wave height on the lee side of the floating breakwater (FBW), and a float of a width B of 26 meters is typically needed to attenuate seventy percent (70%) of the wave height on the lee side of the floating breakwater (FBW).

The characteristics of embodiments of a floating breakwater (FBW) with a single baffle or skirt wall are shown as trials corresponding to configuration nos. 2 through 17 in the graph 710 of FIG. 7 and in Tables 1 and 2. Wave transmission coefficients $K_{ts}$ of 0.5, 0.4, and 0.3 can be achieved with an average $B/L_p$ ratio of 0.46, 0.57, and 0.68, respectively. Thus, for a design wave length of 40 meters (m), widths B of a float of a floating breakwater of 18.4 m, 22.8 m, and 27.2 m are typically needed or are desirable to result in wave height reductions of 50%, 60% and 70%, respectively, on the leeward side of the floating breakwater, for example. Changing the height or porosity, or both, of the baffle or skirt wall typically can have an effect on these parameters, as indicated in Table 1, with these differences in baffle height and porosity being useful in the design of embodiments of a floating breakwater for different conditions, uses or applications, for example.

The characteristics of a floating breakwater (FBW) with two baffles or skirt walls are shown as trials corresponding to configuration nos. 18 through 21 in the graph 710 of FIG. 7 and in Tables 1 and 2. Wave transmission coefficients $K_{ts}$ of 0.5, 0.4, and 0.3 can be achieved with an average $B/L_p$ ratio of 0.285, 0.55, and 0.72, respectively. Thus, for a design wave length of 40 meters (m), widths B of a float of a floating breakwater of 11.4 m, 22.0 m, and 28.8 m are typically needed or are desirable to achieve wave transmission coefficients $K_{ts}$ of 0.5, 0.4, and 0.3, respectively, such as can provide wave height reductions of 50%, 60% and 70% on the leeward side of the floating breakwater, for example.

The characteristics of a floating breakwater (FBW) with three baffles or skirt walls are shown as trials corresponding to configuration nos. 22 through 25 in the graph 710 of FIG. 7 and in Tables 1 and 2. Wave transmission coefficients $K_{ts}$ of 0.5, 0.4, and 0.3 can be achieved with an average $B/L_p$ ratio of 0.253, 0.355, and 0.658, respectively. Thus, for a design wave length of 40 meters (m), widths B of a float of a floating breakwater of 10.12 m, 14.2 m, and 26.32 m are typically needed or are desirable to achieve wave transmission coefficients $K_{ts}$ of 0.5, 0.4, and 0.3, respectively, as can provide wave height reductions of 50%, 60% and 70% on the leeward side of the floating breakwater, for example.

The characteristics of a floating breakwater (FBW) with five baffles or skirt walls are shown as trials corresponding to configuration nos. 26 through 29 in the graph 710 of FIG. 7 and in Tables 1 and 2. Wave transmission coefficients $K_{ts}$ of 0.5, 0.4, and 0.3 can be achieved with an average $B/L_p$ ratio of 0.22, 0.33, and 0.61, respectively. Thus, for a design wave length of 40 meters (m), widths B of a float of a floating breakwater of 8.8 m, 13.2 m, and 24.4 m are typically needed or are desirable to achieve wave transmission coefficients $K_{ts}$ of 0.5, 0.4, and 0.3, respectively, as can provide wave height reductions of 50%, 60% and 70% on the leeward side of the floating breakwater, for example.

The test and analysis results for a fixed pontoon breakwater corresponding to configuration no. 30 in Table 1 are described immediately below. Wave transmission coefficients $K_{ts}$ of 0.5, 0.4, and 0.3 can be achieved with an average $B/L_p$ ratio of 0.31, 0.47, and 0.65, respectively, for example. Thus, for a design wave length of 40 meters (m), widths B of a float of a breakwater of 12.4 m, 18.8 m, and 26.0 m are typically needed or are desirable to achieve wave transmission coefficients $K_{ts}$ of 0.5, 0.4, and 0.3, respectively, for example.

From the above Table 1, a desirable embodiment of the floating breakwaters tested to achieve a wave transmission coefficient $K_{ts}$=0.5 is configuration no. 26, since the $B/L_p$ value is relatively minimum (0.20) for this configuration. Similarly, a desirable embodiment of the floating breakwaters tested to achieve a wave transmission coefficient $K_{ts}$=0.4 are configuration nos. 26 and 28, since the $B/L_p$ value is relatively minimum (0.31) for these configurations. Also, a desirable embodiment of the floating breakwaters tested to achieve a wave transmission coefficient $K_{ts}$=0.3 is configuration no. 29, since the $B/L_p$ value is relatively minimum (0.52) for this configuration.

To generally summarize the above-described results of the tests and analysis, for a design peak wave length of 40 m, to achieve a wave transmission coefficient $K_{ts}$ of 0.5 for a floating breakwater (FBW) without any baffle or skirt wall, a float of a width B of about 17.2 m is typically needed or is desirable, for example. Providing a single baffle or skirt wall does not necessarily significantly improve the wave transmission performance, since such a single baffle or skirt wall can act as a wave generator. However, for a floating breakwater (FBW) with two, three and five baffles or skirt walls, a width B of the float of a floating breakwater of about 11.4 m, 10.12 m and 8.8 m, respectively, is typically needed or desirable to achieve a wave transmission coefficient $K_{ts}$ of 0.5 for a floating breakwater (FBW), and can result in a reduction or savings of about 33.7%, 41.2% and 48.8% in the value of the width B of the float of the floating breakwater, respectively, for example. Also, for a fixed float or pontoon breakwater, a width B of the float of 12.4 m is typically needed or desirable to achieve a wave transmission coefficient $K_{ts}$ of 0.5 for such fixed float or pontoon breakwater, for example. However, such a fixed float can result in relatively high forces being encountered in comparison to a floating breakwater.

Also in summary, to achieve a wave transmission coefficient Kts of 0.4 for a floating breakwater without a depending baffle or skirt wall, a width B of the float of about 21.6 m is typically needed, for example. However, for a floating breakwater (FBW) with two, three and five baffles or skirt walls, respective widths B of the float of about 22.0 m, 14.2 m, and 13.2 m are typically needed or are desirable to achieve a wave transmission coefficient $K_{ts}$ of 0.4, for example. As indicated, there is not necessarily an apparent substantial reduction in the width B for floats of floating breakwaters with two baffles or skirt walls in order to achieve a wave transmission coefficient $K_{ts}$ of 0.4, for example. However, to achieve a wave transmission coefficient $K_{ts}$ of 0.4, the width B of the float of the floating breakwater can be reduced appreciably if floating breakwaters with three and five baffles or skirt walls are used, and can result in a reduction or savings of about 34.3% and 38.89% in the value of the width B of the float of the floating breakwater, respectively, for example. As such, the width B of the float of the floating breakwater can be reduced appreciably if configurations of a plurality of baffles or skirt walls, such as three baffles or skirt walls or five baffles or skirt walls, of embodiments of floating breakwaters are used to attenuate the wave action.

Further, in summary, to achieve a wave transmission coefficient $K_{ts}$ of 0.3 for a floating breakwater (FBW), the use of porous or perforated baffles or skirt walls, such as in the three and five baffle or skirt wall configurations of floating breakwaters, can assist in dissipating the wave energy due to its passage through the apertures or perforations in one or more baffles or skirt walls, for example. Thus, significant cost savings in the construction of embodiments of floating breakwaters can be achieved by using multiple porous baffles or skirt walls, for example.

Also, a value of the width B of the float for different floating breakwater (FBW) configurations to achieve wave transmission coefficients Kts of 0.5, 0.4 and 0.3, such as for a design peak wave length of 40 m, can be selected or determined using the graph 710 of FIG. 7 as a guide, for example. However, if the design peak wave length is other than the 40 m length used in conjunction with the embodiments of the floating breakwaters related to the graph of FIG. 7, using a desired value of a wave transmission coefficient $K_{ts}$ in conjunction with a desired $B/L_p$ value, and taking into consideration the porosity of the one or more skirt walls or baffles, can assist in selection of an appropriate width B of the float and a configuration of a floating breakwater, depending on the particular use or application, for example. Further, if the desired peak wave length is different than 40 m, then Table 1 can be used to select the appropriate width B of the float of a floating breakwater (FBW) for a desired floating breakwater configuration. For example, if a wave transmission coefficient $K_{ts}$ value of 0.4 is desired, and the design wave length is 50 m, then, using Table 1, floating breakwater configuration no. 26 or 28 can be selected, since the $B/L_p$ value (0.31) is a relative minimum for these two embodiments out of the 29 floating breakwater (FBW) embodiments corresponding to the configuration nos. tested and analyzed, for example. Therefore, in this example, a desirable width B of the float of the floating breakwater can be 0.31×50=15.5 m.

It will be seen that numerous variations can be incorporated with the floating breakwater embodiments of the present invention. For example, the perforations or apertures, such as perforations or apertures 226 illustrated in the baffle 220 of the embodiment of the floating breakwater 210 of FIG. 2, need not be circular shaped perforations or apertures, as shown, but can include any other non-circular shape, or other various shapes, as desired. Also, the one or more baffles or skirt walls do not necessarily have to be normal or substantially normal to the bottom surface of the float of the floating breakwater, but the one or more baffles or skirt walls, such as the forward face thereof, can be at an acute or an obtuse angle relative to the bottom surface of the float of the floating breakwater, such as depending on the use of application, and should not be construed in a limiting sense.

Also, the baffles or skirt walls attached to a surface of the float of the embodiments of the floating breakwater, such as desirably attached to depend from the float bottom surface, or as can be attached to another surface of the float, for example, can be attached to a surface of the floating breakwater, such as to the bottom surface of the float of the floating breakwater, by cantilevering, with no additional external support for the baffles or skirt walls, for example. However, external bracing elements (e.g., rods, wires, etc.) can also be used to secure the baffles or skirt walls in place to the float of the floating breakwater and to one another, such as where plural baffles are provided, for example, and should not be construed in a limiting sense.

Also, it should be noted that the quantity of baffles or skirt walls need not be limited only to the one, two, three and five baffles or skirt walls illustrated and described, but can include any of various numbers of baffles or skirt walls, such as depending on the particular use or application, for example. Other variations in dimensions and configurations for embodiments of floating breakwaters, in addition to those described or illustrated, can also be feasible, for example. Further, the various components of embodiments of floating breakwaters, such as the float and the baffles or skirt walls, can be made of any of various suitable materials, such as various plastics, metals, wood, rubber or other suitable materials, and combinations thereof, such as can be reasonably economical and durable materials, for example.

It is to be understood that the present invention is not limited to the embodiments described above, but encompasses any and all embodiments within the scope of the following claims.

We claim:

1. A method of constructing a floating breakwater for a predetermined wave transmission coefficient $K_{ts}$ and a predetermined incident wave length $L_p$ of an oncoming wave, wherein the wave transmission coefficient $K_{ts}$ is a ratio of a transmitted wave height of an attenuated wave to an incident wave height of an oncoming wave, and Lp is the incident wave length of the oncoming wave, the method comprising:

selecting a predetermined wave transmission coefficient;

measuring the incident wave length of the oncoming wave;

constructing a float, the float having a width B, a bottom surface, a front surface, and five skirt walls extending downward from and along the bottom surface of the float, each of the five skirt walls consisting of an upper edge, a bottom edge, a front face and a rearward face, each of the upper edges of the skirt walls being contiguous to the bottom surface of the float, wherein the front surface of the float is adapted to be positioned in facing relation to a direction of an oncoming wave, the width B is in a direction substantially parallel to a direction of wave travel, and each of the skirt walls has its front face adapted to be positioned in facing relation to the direction of the oncoming wave to attenuate the oncoming wave to lessen an amplitude of the oncoming wave; and determining the width B for the float for a predetermined wave transmission coefficient $K_{ts}$, the width B being determined based on a value of $B/L_p$.

2. The method of constructing a floating breakwater according to claim 1, wherein each of the five skirt walls each are of a substantially equal depth and are positioned in substantially evenly spaced relation to one another.

3. The method of constructing a floating breakwater according to claim 1, wherein each of the five skirt walls is selected from the group consisting of a monolithic plate and a porous plate, the porous plate having one or more apertures.

4. The method of constructing a floating breakwater according to claim 1, wherein the float has a substantially flat, planar bottom surface, and each of the five skirt walls being imperforate and extends downward from the bottom surface of the float at an angle substantially normal to the bottom surface of the float.

5. The method of constructing a floating breakwater according to claim 1, further comprising:

a plurality of mooring lines extending from the float to anchor the floating breakwater.

6. The method of constructing a floating breakwater according to claim 1, wherein each of the five skirt walls are porous and includes one or more apertures adapted to dissipate wave energy of the oncoming wave.

7. The method of constructing a floating breakwater according to claim 6, wherein each of the five skirt walls are of a substantially equal depth and are positioned in substantially evenly spaced relation to one another.

8. The method of constructing a floating breakwater according to claim 1, wherein the predetermined wave transmission coefficient $K_{ts}$ is selected from the group of values consisting of 0.5, 0.4, and 0.3.

* * * * *